US009868013B1

(12) United States Patent
Leverenz et al.

(10) Patent No.: US 9,868,013 B1
(45) Date of Patent: Jan. 16, 2018

(54) STRETCHING TOOL AND METHOD FOR POST-SURGERY PATIENT RECOVERY

(71) Applicants: Mark Leverenz, Blue Grass, IA (US); Kristie Leverenz, Blue Grass, IA (US)

(72) Inventors: Mark Leverenz, Blue Grass, IA (US); Kristie Leverenz, Blue Grass, IA (US)

(73) Assignee: United Therapy Services, Inc., Blue Grass, IA (US)

( * ) Notice: Subject to any disclaimer, the term of this patent is extended or adjusted under 35 U.S.C. 154(b) by 28 days.

(21) Appl. No.: 14/958,930

(22) Filed: Dec. 3, 2015

Related U.S. Application Data

(60) Provisional application No. 62/087,192, filed on Dec. 3, 2014.

(51) Int. Cl.

| | |
|---|---|
| ***B65D 33/06*** | (2006.01) |
| ***B65D 33/10*** | (2006.01) |
| ***A63B 21/002*** | (2006.01) |
| ***A63B 21/00*** | (2006.01) |
| ***A63B 23/04*** | (2006.01) |
| *A63B 23/00* | (2006.01) |

(52) U.S. Cl.
CPC ..... *A63B 21/00185* (2013.01); *A63B 23/04* (2013.01); *A63B 21/0023* (2013.01); *A63B 2023/006* (2013.01); *A63B 2208/0252* (2013.01); *B65D 33/06* (2013.01)

(58) Field of Classification Search
CPC ..... A63B 21/002; A63B 21/0023; A63B 21/00185; A63B 21/00043; A63B 21/055; A63B 21/0552; A63B 23/04; A63B 2023/006; A63B 21/068
USPC ..... 182/196–199; 383/6, 16
See application file for complete search history.

(56) References Cited

U.S. PATENT DOCUMENTS

| | | | | | |
|---|---|---|---|---|---|
| 458,023 | A * | 8/1891 | Kimball | E06C 9/14 | 182/129 |
| 1,564,101 | A * | 12/1925 | Nakamura | A45F 5/10 | 294/155 |
| 1,979,263 | A * | 11/1934 | Halpin | A45C 13/22 | 383/16 |
| 3,315,857 | A * | 4/1967 | Eclov | A45C 13/38 | 294/152 |
| 4,062,392 | A * | 12/1977 | Ishii | A45C 7/0063 | 383/16 |

(Continued)

*Primary Examiner* — Nyca T Nguyen
(74) *Attorney, Agent, or Firm* — Hamilton IP Law, PC; Jay R. Hamilton; Charles Damschen

(57) ABSTRACT

A stretching tool and method for post-surgery patient recovery is disclosed having a bag design to enclose a patient's foot for stretching exercises with incremental ladder like grips or handles positioned on a pair of longer straps. The least amount of stretch generated by grabbing the inner most straps or grips and greatest amount of stretch generated by grabbing the straps or grips outermost. The dual laddered straps facilitate a controlled and symmetrical self-stretch which inhibits protective responses, yielding a superior stretch. The incremental handles and grips to the long straps accommodate any height/size of patient. The grips promote increased relaxation while being able to apply force necessary for stretch. The stretching tool inhibits protective responses which are highly beneficial for the painful joint that requires motion and stretching post knee and hip arthroplasty. The straps and grips may be conveniently enclosed in the bag during non-use.

4 Claims, 12 Drawing Sheets

(56) References Cited

U.S. PATENT DOCUMENTS

| | | | | | |
|---|---|---|---|---|---|
| 5,540,178 | A * | 7/1996 | Damron | B63B 27/14 | 114/362 |
| 5,628,380 | A * | 5/1997 | Matisi | A62B 5/00 | 182/196 |
| D472,709 | S * | 4/2003 | Vazquez | D3/303 | |
| 7,455,028 | B2 * | 11/2008 | Baker | B63B 27/14 | 114/362 |
| 9,220,330 | B2 * | 12/2015 | Kelson | A45C 13/38 | |
| 2011/0281699 | A1 * | 11/2011 | Torres | A63B 21/00043 | 482/131 |
| 2012/0040808 | A1 * | 2/2012 | Khademi | A63B 21/0557 | 482/124 |
| 2015/0231438 | A1 * | 8/2015 | Romero Urias | A63B 21/00185 | 482/131 |

* cited by examiner

STRETCHING TOOL AND METHOD FOR POST-SURGERY PATIENT RECOVERY

CROSS REFERENCE TO RELATED APPLICATIONS

Applicant states that this non-provisional utility patent application claims priority from provisional U.S. Pat. App. 62/087,192 filed on Dec. 3, 2014, which application is incorporated by reference herein in its entirety.

FIELD OF THE INVENTION

The present disclosure relates to a device and method of use therein allowing users seeking to increase lower extremity flexibility, including patients after knee and hip arthroplasty (replacement) surgery, to stretch their lower extremity without the assistance of another person and without supervision of a doctor or other health care provider.

STATEMENT REGARDING FEDERALLY SPONSORED RESEARCH OR DEVELOPMENT

No federal funds were used to develop or create the invention disclosed and described in the patent application.

REFERENCE TO SEQUENCE LISTING, A TABLE, OR A COMPUTER PROGRAM LISTING COMPACT DISK APPENDIX (Not Applicable)

AUTHORIZATION PURSUANT TO 37 C.F.R. §1.171 (d)(c)

A portion of the disclosure of this patent document may contain material that is subject to copyright and trademark protection. The copyright owner has no objection to the facsimile reproduction by anyone of the patent document or the patent disclosure, as it appears in the Patent and Trademark Office patent file or records, but otherwise reserves all copyrights whatsoever.

BACKGROUND AND OBJECTIVES

The stretching tool as disclosed is for effective self-stretching and motion aide for patients. One objective of the stretching tool is to facilitate therapist-quality self-stretching by patients rehabilitating after total knee replacement.

Another objective of the stretching tool disclosed is to assist users with recovering from a variety of deficits related to the lower body including recovering from joint replacement surgery or managing low back pain by improving flexibility. Another objective is for users with a painful lower extremity, such as after total knee replacement, is improved stretching by increased efficiency and user control. It is a problem in the art that a lack of user control can produce or initiate user protective responses which are counterproductive to therapeutic goals. The stretching tool and method of use disclosed and claimed herein allow this type of control and achieve this objective via the compartment of the stretching tool encompassing the foot combined with bilateral hand grips providing user confidence in the prescribed motion or stretch.

Another objective is to provide the user with goniometric feedback during use of the stretching tool which motivates the user to exercise using the stretching tool improving recovery.

Another objective is to provide the user of the stretching tool with the benefit of decreasing the risk of user developing arthrofibrosis post-surgery.

DETAILED DESCRIPTION—BRIEF DESCRIPTION OF DRAWINGS

Figure 2:
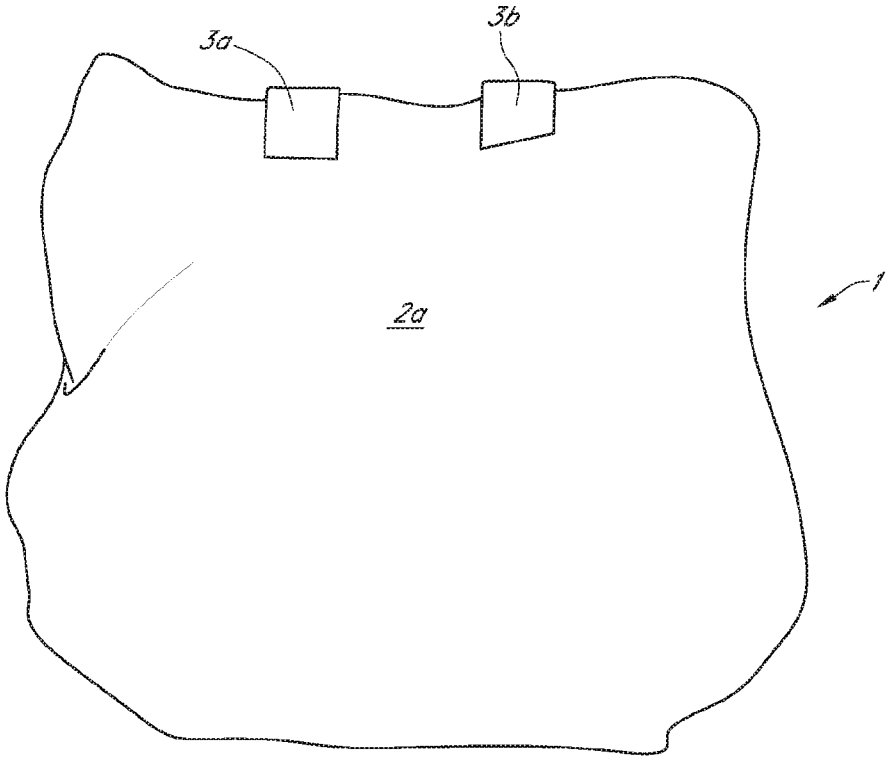

FIG. 2 is a side view of the one side of bag 2 with the first and second ends of the long strap, respectively 3*a* and 3*b*, disclosed.

Figure 3:
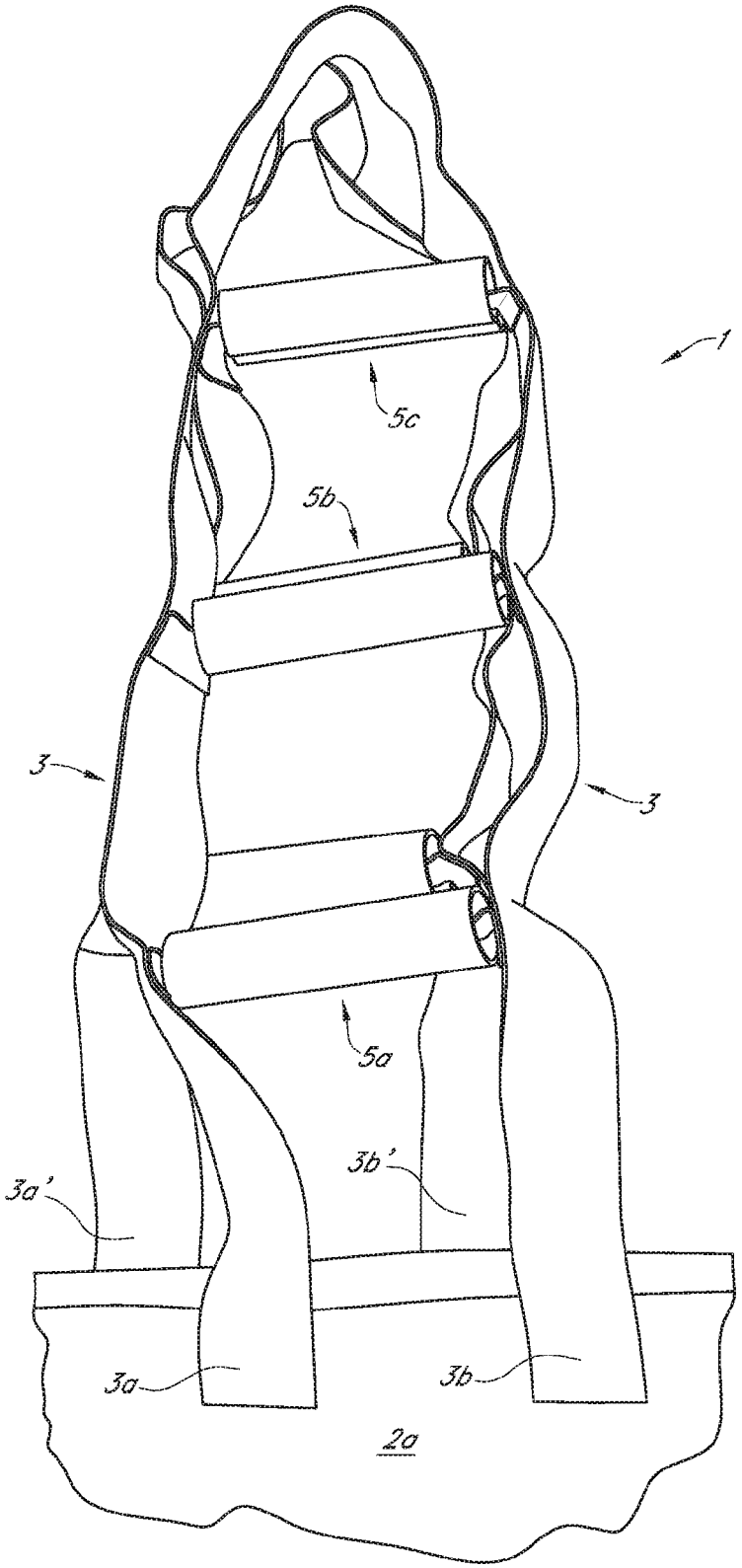

FIG. 3 is a front view of the stretching tool 1 disclosed with both long straps 3 deployed.

Figure 4:
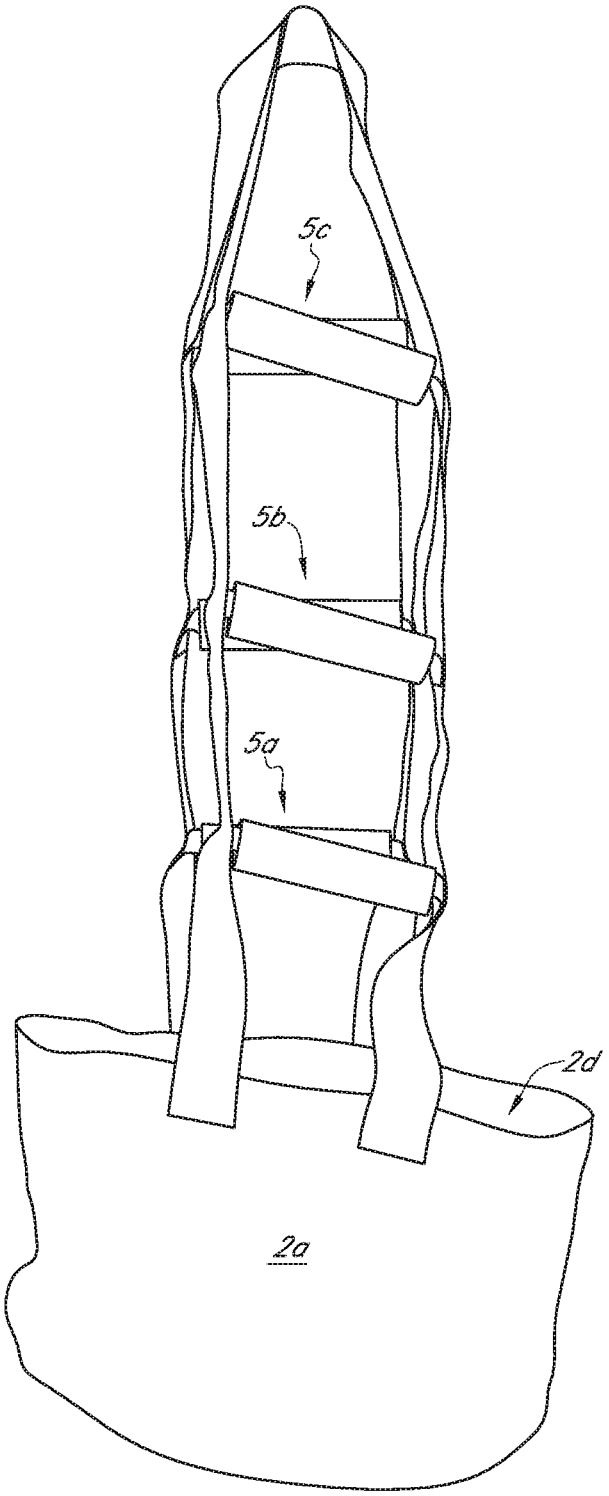

FIG. 4 is another view of the stretching tool 1 deployed similar to how a user 20 would make use of the compartment 2*d* of the bag 2.

Figure 5:
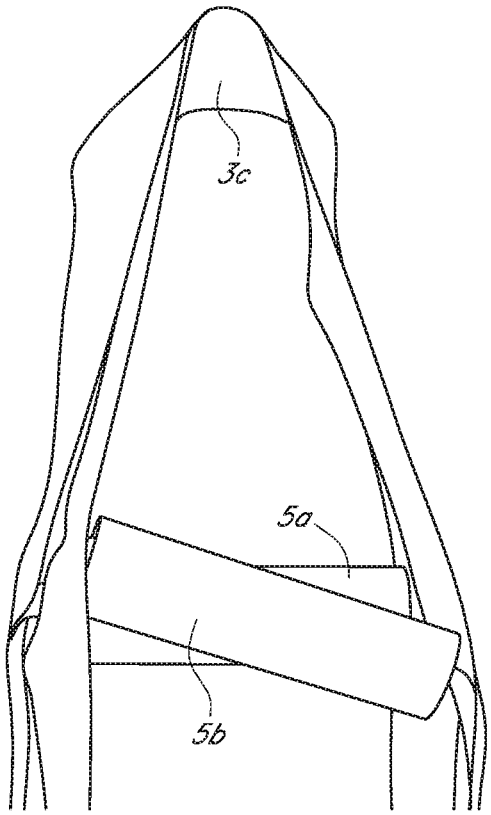

FIG. 5 is a detailed view of the stretching tool 1 at the apex 3*c* of the long strap the most distal handle strap 4 with grip 5 position allowed.

Figure 6:
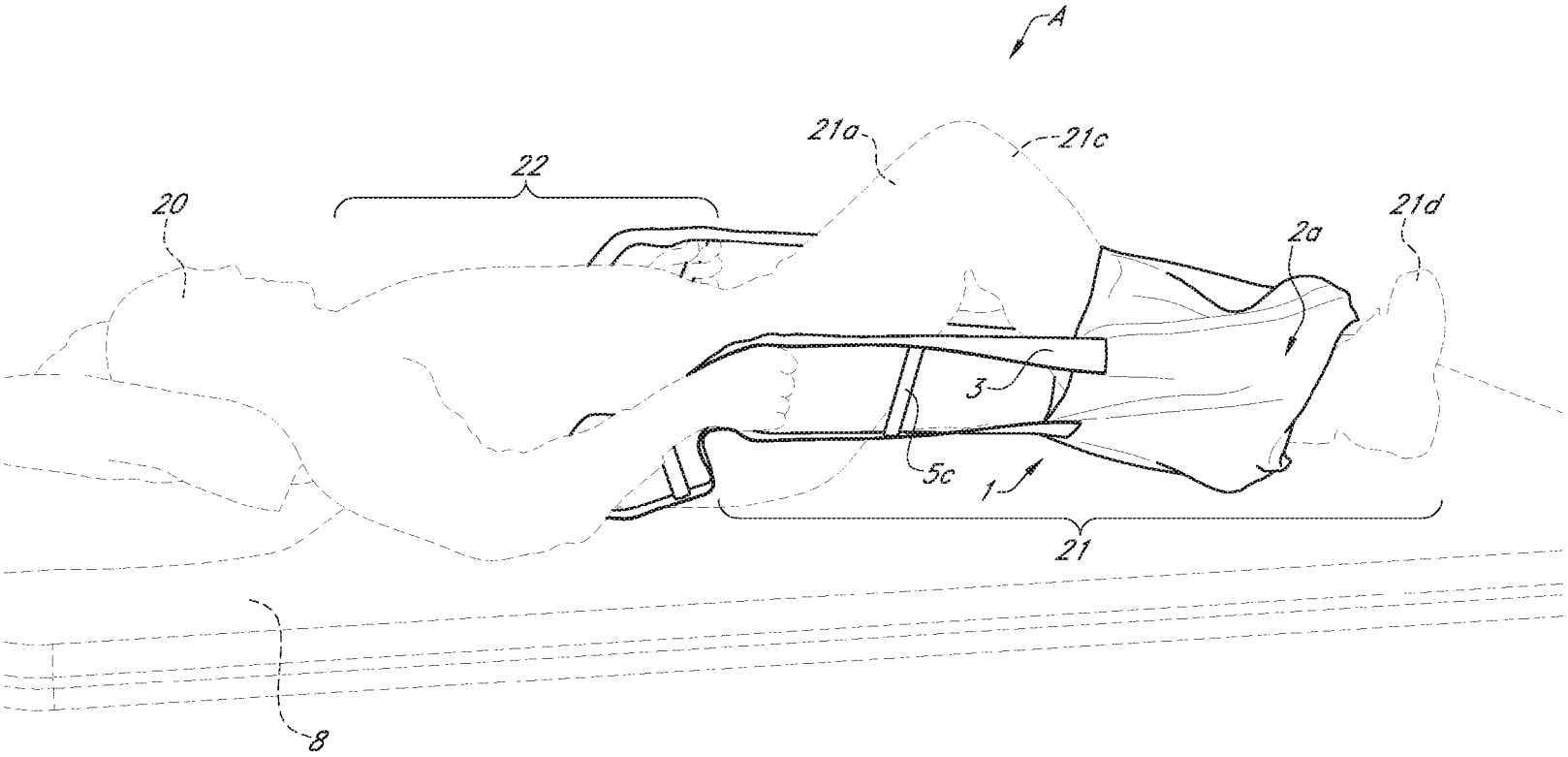

FIG. 6 provides an illustration of a user 20 in a first position (A) using the stretching tool for a knee stretch.

Figure 7:
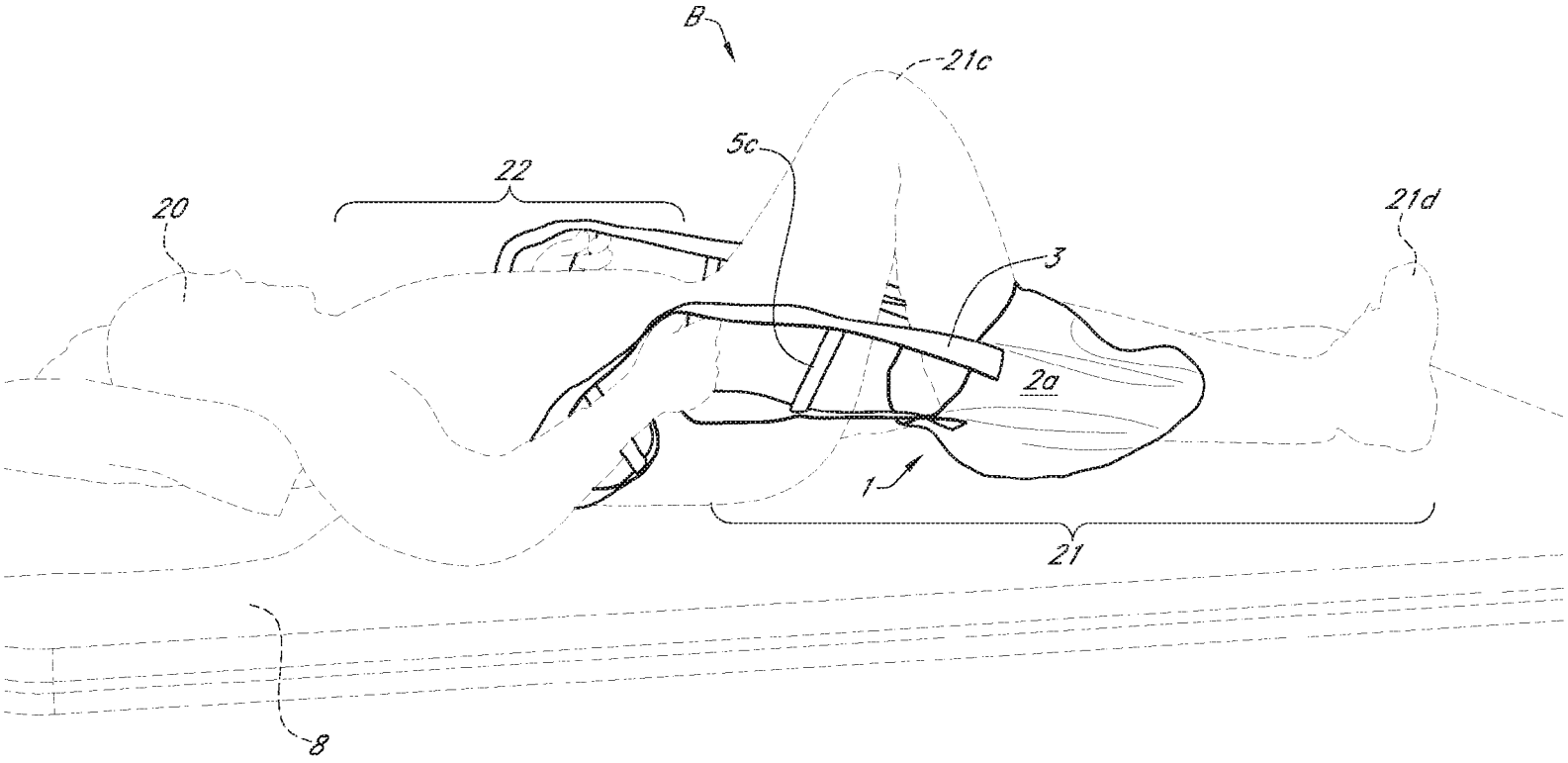

FIG. 7 provides an illustration of a user 20 in a second position (B) using the stretching tool for a knee stretch.

Figure 8:
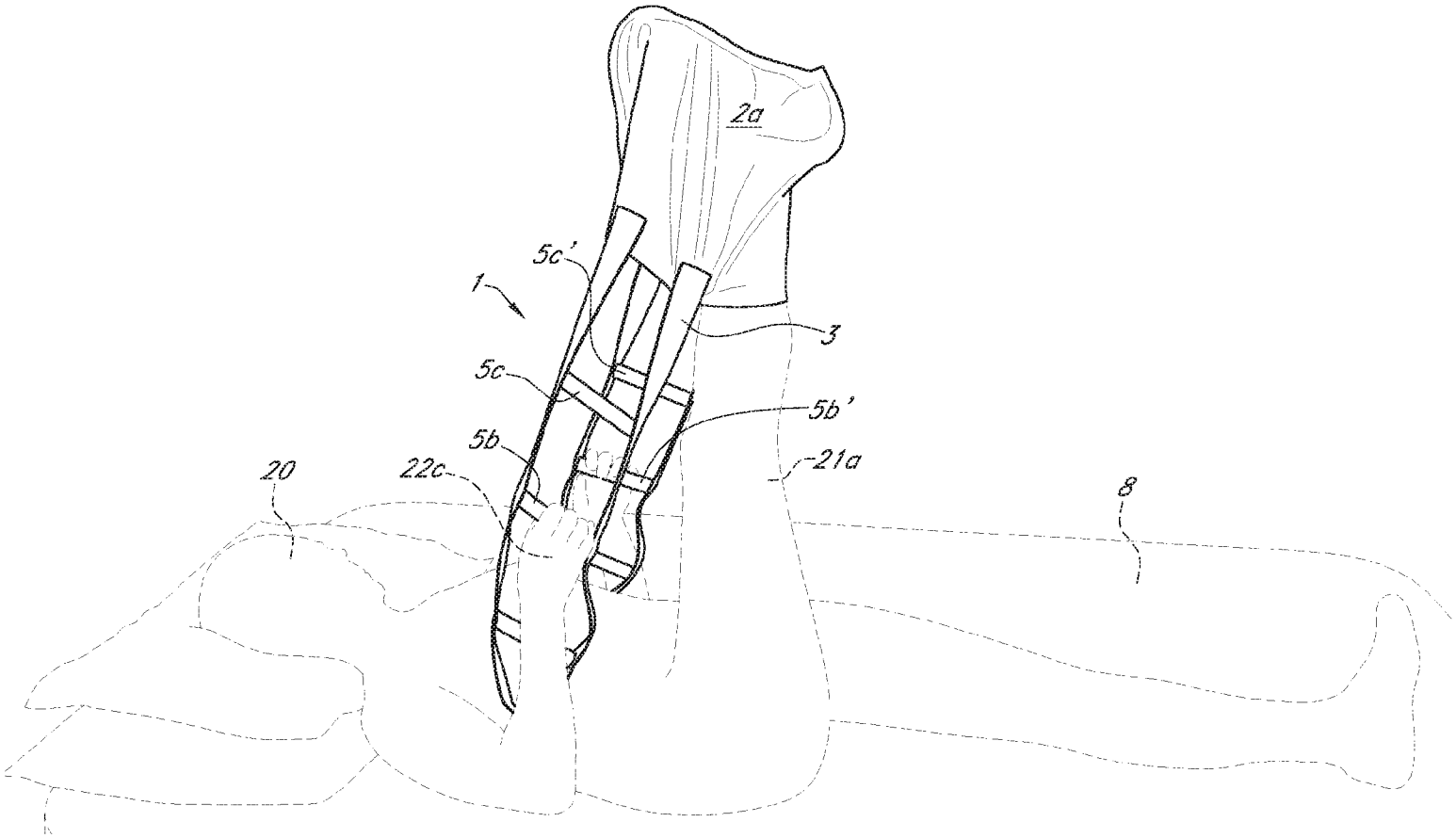

FIG. 8 provides an illustration of a user 20 using the stretching tool 1 with their leg elevated for a hamstring stretch.

Figure 9:
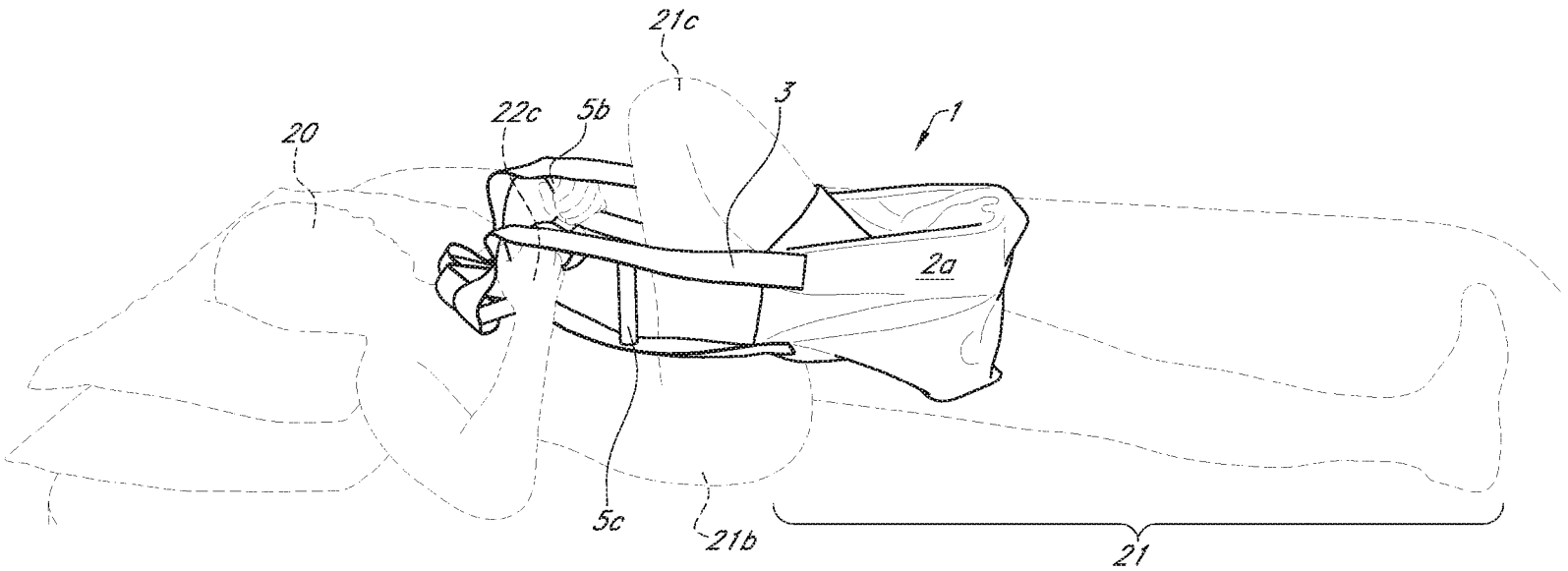

FIG. 9 provides an illustration of a user 20 in a first position (A) using the stretching tool 1 to stretch their hip 21*b*.

Figure 10:
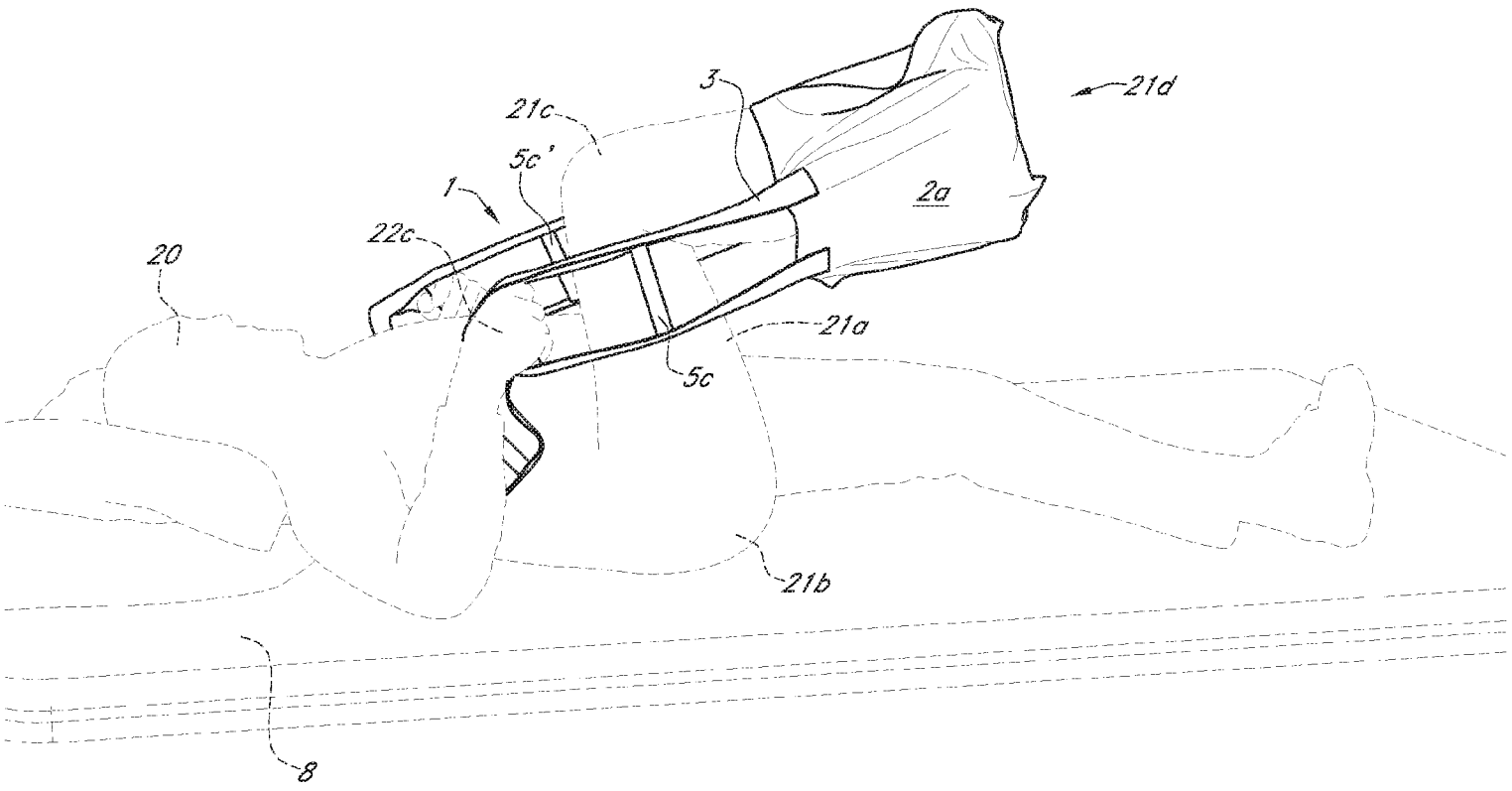

FIG. 10 provides an illustration of a user 20 in a second position (B) using the stretching tool 1 to stretch their hip 21*b*.

Figure 11:
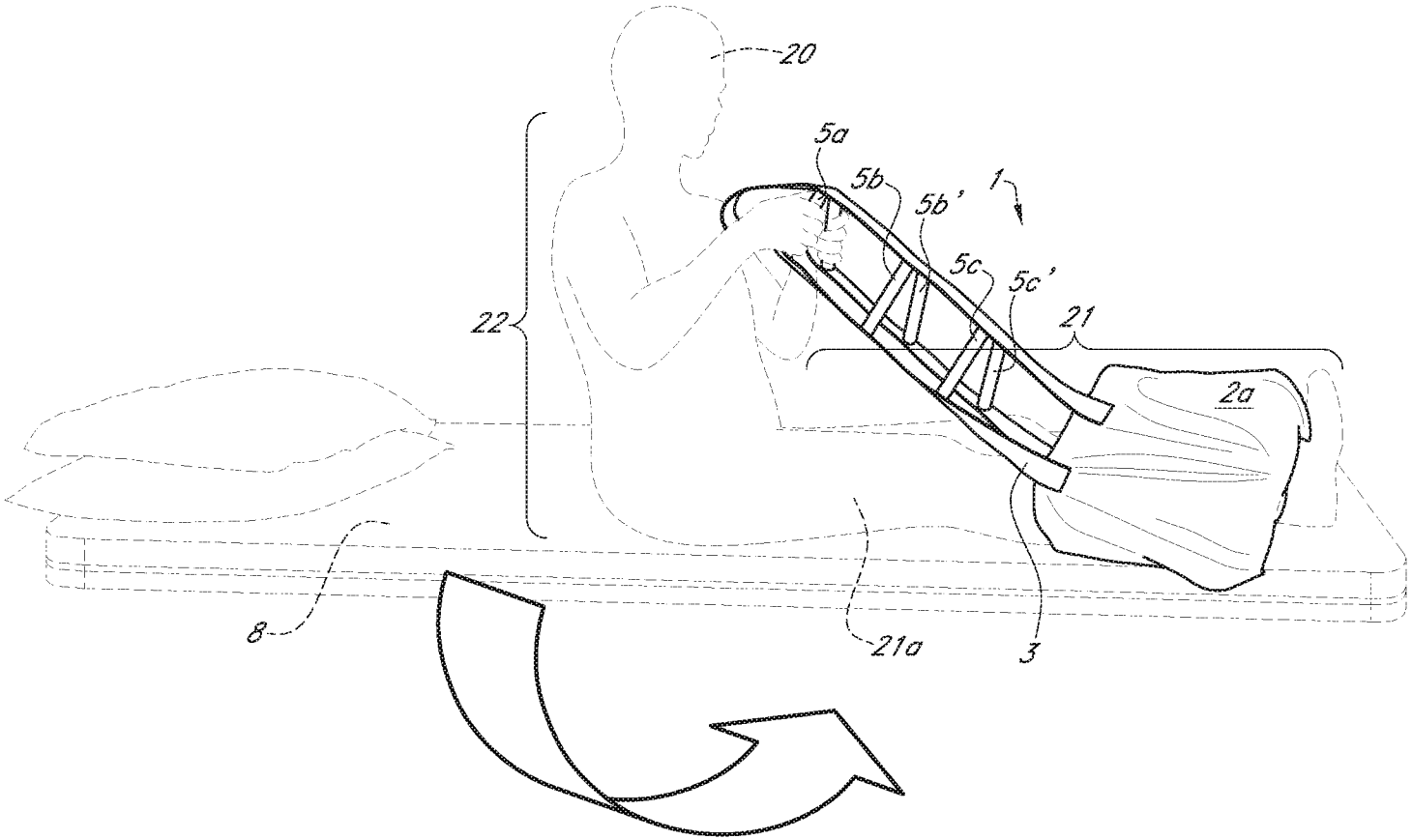

FIG. 11 provides an illustration of a user 20 using stretching tool 1 as a leg lifter.

Figure 12:
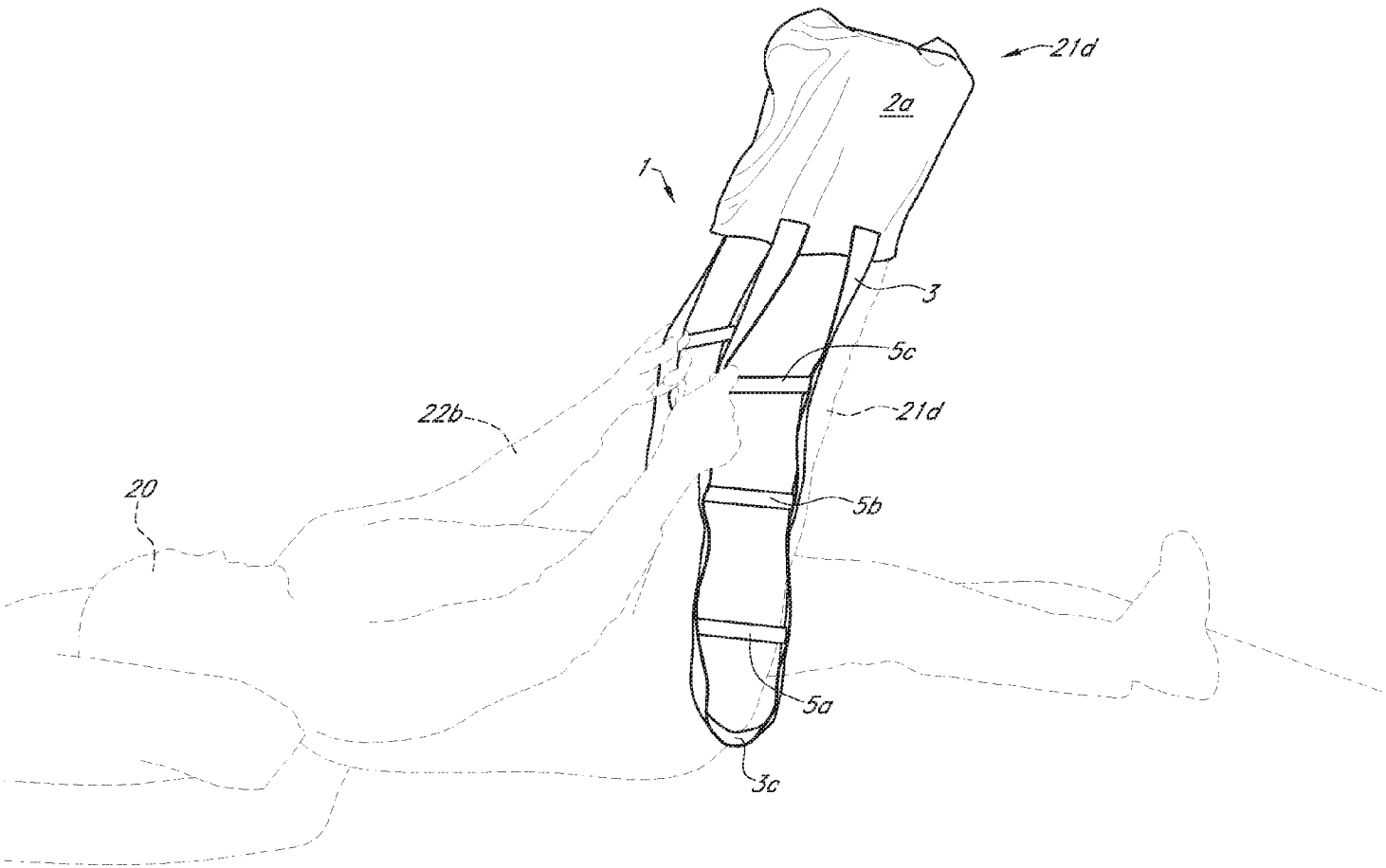

FIG. 12 provides an illustration of a user 20 using the stretching tool 1 with their leg elevated to stretch the heelcord of their leg.

DETAILED DESCRIPTION—LISTING OF ELEMENTS

| Element Description | Element Number |
|---|---|
| Stretching Tool | 1 |
| Bag | 2 |
| Bag - first side | 2a |
| Bag - second side | 2b |
| Bag - open side | 2c |
| Bag - compartment | 2d |
| Long strap | 3 |
| Long strap - attached first end | 3a |
| Long strap - attached second end | 3b |
| Long strap - midpoint (apex) | 3c |
| Handle strap | 4 |
| Grips | 5 |
| Support surface (table or floor) | 8 |
| Compartment | 10 |
| User (patient) | 20 |

-continued

| Element Description | Element Number |
|---|---|
| Lower extremity | 21 |
| Leg | 21a |
| Hip | 21b |
| Knee | 21c |
| Foot | 21d |
| Upper extremity | 22 |
| Back | 22a |
| Arm | 22b |
| Hand | 22c |

DETAILED DESCRIPTION OF INVENTION

Before the various embodiments of the present invention are explained in detail, it is to be understood that the invention is not limited in its application to the details of construction and the arrangements of components set forth in the following description. The invention is capable of other embodiments and of being practiced or of being carried out in various ways. Also, it is to be understood that phraseology and terminology used herein with reference to device or element orientation (such as, for example, terms like "front", "back", "up", "down", "top", "bottom", and the like) are only used to simplify description of the present invention, and do not alone indicate or imply that the device or element referred to must have a particular orientation. In addition, terms such as "first", "second", and "third" are used herein and in the appended claims for purposes of description and are not intended to indicate or imply relative importance or significance.

The following detailed description is of the best currently contemplated modes of carrying out illustrative embodiments of the invention. The description is not to be taken in a limiting sense, but is made merely for the purpose of illustrating the general principles of the invention, since the scope of the invention is best defined by the appending claims. Various inventive features are described below herein that can each be used independently of one another or in combination with other features.

Illustrative Embodiment and Advantages of Invention

The stretching tool 1 and method for post-surgery patient recovery disclosed herein allows people, primarily patients after knee and hip arthroplasty (replacement) surgery, to stretch their lower extremity without the assistance of another person. However, the device is applicable to any situation where hip or knee stretching into flexion (bending) is indicated (not shown). Therefore, applicant may refer to "patients" or "users" or "people" without departure and considers all terms to define a user of the stretching tool 1 and its methods of use herein. Further, the stretching tool 1 as deployed in at least one embodiment is conveniently packaged as a simple bag 2, as illustrated in FIGS. 1-5 through-out and particularly herein at FIGS. 1, 2 and 3 with the bag portion sized to allow most foot and shoe sizes inside to fix the position of the foot 21*d* during the stretching exercise, and two laddered long straps 3 attached to the bag 2 at both ends (3*a*, 3*b*) and with one long strap (3, 3') on either side of the bag (2*a*, 2*b*). As shown, the long strap 3 may be constructed as a "U" shape having both ends attached to the bag 2. The laddered straps 3 allow incremental and symmetrical pull to be applied by the patient as their range of motion improves. Although not shown, one of ordinary skill will appreciate that long strap 3 may be implemented via two slightly shorter straps not forming a "U" shape without departure from the present disclosure. Though not the primary function, the stretching tool 1 can allow for the users arms to compensate for a weak leg during tasks such as transitioning in or out of bed. (See FIG. 11 illustrating the user having swung their leg up onto the table), an auxiliary use for the device is as a leg-lifter. The stretching tool 1 satisfies the need for an effective self-stretching device that would allow therapist-like stretching to be accomplished by the patient. Payer source trends for therapy services are focused on cost-containment, shifting more responsibility from therapists to patients in regards to therapy interventions. The stretching tool 1 and its method of use facilitate patient participation in their own recovery process, moving them farther away from being passive recipients of care. Use of towels, belts and sheets are commonly prescribed to aide a patient with self-stretching of the knee and hip. However, these approaches require considerable effort by the patient (user) to maintain hand grasp and foot position which may stimulate protective responses, and therefore a less effective stretch. The stretching tool 1 employed with the bag 2 design envelops the foot 21*d* providing consistent stability and comfort so the patient 20 does not have to divert effort to keep their leg 21*a* in the stretching tool 1 (See FIGS. 6-12). Further, the stretching tool 1 allows the patient 20 to independently apply the necessary forces for effective stretching, as illustrated in FIGS. 6-12 herein.

Figure 1A:
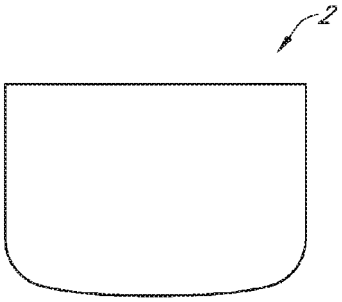
FIG. 1A is a detailed side view of the bag 2 which comprises one element of the stretching tool 1 disclosed.
Figure 1B:
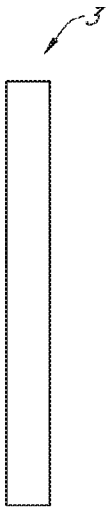
FIG. 1B is a detailed side view of the long strap 3 which comprises one element of the stretching tool 1 disclosed.
Figure 1C:
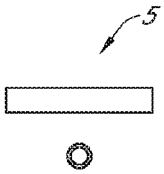
FIG. 1C is a side and end view of the grip 5 which comprises one element of the stretching tool 1 disclosed.
Figure 1D:
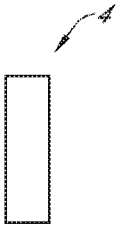
FIG. 1D is a side view of the handle strap 4 which comprises one element of the stretching tool 1 disclosed.
Figure 1:
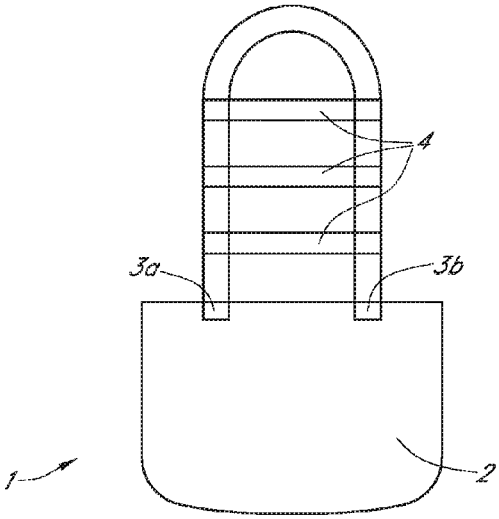
FIG. 1 is a side view of the stretching tool 1 of the present disclosure.

FIG. 1 is a side view of the stretching tool 1 having a pair of long straps 3 attached to each side of the bag 2*a*, 2*b* which at each end. As shown, three shorter handle straps 4 are attached between the pair of long straps 3, 3'. (See FIG. 3 discussed supra herein) Handle grips 5 are then positioned over the shorter handle straps 4 positioned between each end of each longer strap 3, 3'. Handle straps are positioned approximately every 4-8 inches on the longer strap 3. As shown in FIGS. 1-5, the handle straps are positioned approximately every 7 inches on the longer strap 3. The dimensions disclosed in no way limit the breadth of applicant's disclosure or claims. As shown the grips 5 affixed to each long strap 3 should be positioned incrementally and symmetrically along each long strap 3 and in relation to each other.

FIG. 1A is a detailed side view of the bag 2 which comprises one element of the stretching tool 1 disclosed. As shown, the bag 2 is constructed having two sides, 2*a*, 2*b*, respectively. Although the bag 2 may have any dimension, as shown has an opening width of 17 inches and lower width of 12.5 inches which in this illustration is constructed of canvas. As shown, the bag has height (depth) dimension of 14 inches. It has been found that the dimension of 16-19 inches wide and a dimension of 12-16 inches tall is suitable for most applications as that particular size range allows use by a large percentage of patients likely to use the stretching tool 1. FIG. 1B is a detailed side view of the long strap 3 which comprises one element of the stretching tool 1 which in this illustration is constructed of nylon or polypropylene. As shown, the long strap 3 has two ends and a length dimension of 57 inches and width dimension of 1.5 inches. It has been found that the length dimension of 55-65 inches long and a width dimension of up to 3 inches is suitable for most applications as that particular size range allows use by a large percentage of patients 20 likely to use the stretching tool 1. FIG. 1C is a side and end view of the grip 5 which comprises one element of the stretching tool 1 disclosed which in this illustration is constructed of rubber or PVC. As shown, the grip 5 has a length dimension of 4.5 inches and diameter of 1.25 inches. It has been found that the length dimension of 4-7 inches long and a diameter dimension of up to 2.5 inches is suitable for most applications as that particular size range allows use by a large percentage of patients likely to use the stretching tool 1. FIG. 1D is a side view of the handle strap 4 which comprises one element of the stretching tool 1 as disclosed which in this illustration is constructed of nylon or polypropylene. As shown, the handle strap 4 has a length dimension of 6 inches and a width dimension of 1.5 inches. It has been found that the length dimension of 5-7 inches long and a width dimension of up to 2.5 inches is suitable for most applications as that particular size range allows use by a large percentage of patients likely to use the stretching tool 1. FIG. 2 is a side view of the one side of bag 2 with the first and second ends of the long strap, respectively 3*a* and 3*b*, disclosed.

One of ordinary skill will appreciate that the bag 2, long straps 3, handle (short) straps 4 and grips 5 may be configured having other dimensions as suitable for the particular application. For example, the bag 2 size may be increased or decreased to accommodate any foot size, with or without shoe, and increase contact to LE for increased comfort and relaxation. Further, one of ordinary skill will appreciate the present disclosure is not limited by the means of construction or the materials chosen as other suitable materials, including cloth, plastic, steel or aluminum, and combinations therein without limitation or restriction.

FIG. 3 is a front view of the stretching tool 1 disclosed with both long straps 3 deployed. Although not shown, it will be understood from the figures presented that a patient 20 would use the stretching tool 1 by placing the foot 21*d* of the leg 21*a* (or hip 21*b*) to be stretched into the bag 2 and then gripping one set of handles (5*a*, 5*b*, 5*c*) as positioned on the length of the long straps 3 from the bag 2 portion to the apex 3*c* of the long strap 3 with the least amount of stretch generated by grabbing the inner most straps 4/grips (5*a*) and the greatest amount of stretch generated by grabbing the straps 4/grips (5*c*) outermost. The dual laddered straps 4 facilitate a controlled and symmetrical self-stretch which has been observed to inhibit protective responses, yielding a superior stretch. The incremental handles and grips (4, 5) to the long straps 3 accommodate any height/size of patient and with grips 5 promote increased relaxation while being able to apply force necessary for stretch. The stretching tool 1 inhibits protective responses which are highly beneficial for the painful joint that requires motion and stretching, such as after knee and hip arthroplasty. (See FIGS. 6-12 and discussion herein for further illustration)

FIG. 4 is another view of the stretching tool 1 deployed similar to how a patient would make use of it. FIG. 5 is a detailed view of the stretching tool 1 at the apex 3*c* of the long strap the most distal handle strap 4 with grip 5 position allowed. Further, one of ordinary skill will appreciate that other means and methods are suitable to construct present disclosure stretching tool, such as producing it from plastic with the grips integral the short straps (not shown). Another embodiment contemplated but not shown would be to attach a long strap 3 to each side of the bag (2*a*, 2*b*) proximate the open side 2*c* and position grips 5 at various positions along the length of the long strap 3. Unlike the FIGS. 1-5, the long strap would not form a "U" shape and attach back to the side of the bag (2*a*, 2*b*). Similar to the embodiment disclosed at FIGS. 1-5, the grips 5 would be positioned substantially equidistant and symmetrical along each length of long strap 3 to ensure that during use even grips 5 allow the long straps 3 to generate an incremental and symmetrical pull to be applied by the patient 20 as their range of motion improves.

Illustrative Method of Use 1: Knee Stretching and Range of Motion

The stretching tool 1 disclosed herein is an excellent device for stretching the knee 21*c* of the lower extremity 21 as illustrated in FIGS. 6-7. The user 20 is able to control their own stretch, comfortably sustain the stretch using larger muscle groups of bilateral upper extremities 22 (including back 22*a*, arm 22*b* and hands 22*c*) and may be used in combination with contract relax type stretching strategies. Incorporating the stretching tool 1 into treatment sessions makes home exercises an intuitive transition from clinic to home for a patient user. The stretching tool 1 as disclosed and claimed is an excellent device for stretching and helping to actively move (active assisted range of motion) the joint after knee replacement surgery. (See FIGS. 6-7) Users 20 prefer the stretching tool 1 over traditional methods (i.e. use of a gait belt or sheet) because there is no worry of the foot 21*d* of the lower extremity 21 slipping off the device as the foot 21*d* is secured in compartment 2*d* and the laddered grips 5 provide leverage for the upper body 22 to assist with motion/stretching with improved motion/stretching is under user control; an appreciated feature when moving a painful leg. As shown in FIGS. 6-7, the user 20 may actively assist muscles to bend the leg 21*a* at the knee 21*c* then hold a stretch at the end of the available motion. (Moving from position A to position B) Laying down on a support surface 8, shown as a table but so not limited and which may include the ground, floor surface or bed (not shown) which assists the user with relaxation while moving through the stretches from position A, wherein the knee is slightly bent (an angle in the range of 30-60 degrees), to position B (an angle in the range of 60-90) and range of motion exercises while also eliminating fall risk. One of ordinary skill will appreciate that active user 20 use of the stretching tool 1 decreases user risk of Stiff Knee Syndrome (Arthrofibrosis)—post surgery.

Illustrative Method of Use 2: Hamstring Stretching

Shortened hamstring length is a common characteristic associated with abnormalities in gait and posture, low back pain, sciatica, and many other lower body dysfunctions. FIG. 8 provides an illustration of a user 20 using the stretching tool 1 with one leg 21*a* elevated for a hamstring stretch while laying on a support surface in the supine position. The stretching tool 1 disclosed and claimed is an effective tool for self-stretching the hamstrings (not shown) of the leg 21*a* as shown and called out. Although not shown, one of ordinary skill will appreciate that the user's foot 21*d* of leg 21*a* under stretch is enclosed in bad compartment 2*d*. Hamstring stretching in the supine position stabilizes the pelvis and lumbar spine, which facilitates a pure hamstring stretch while protecting low back structures. The supine position of the user 20 as shown in FIG. 8 also provides a safe position for those with compromised balance whether acute or chronic in nature.

Illustrative Method of Use 3: Hip Stretching and Range of Motion

The stretching tool is also an excellent device for stretching and self-ranging the hip 21*b*, most commonly applicable after surgery or trauma. FIG. 9 provides an illustration of a user 20 in a first position (A) using the stretching tool 1 for to stretch hip 21*b* with their foot 21*d* (hidden in compartment 2*d*) pointed down and their knee 21*c* in a 45 degree bend. Users 20 are able to control their own stretch and motion, comfortably sustain a hip stretch using larger muscle groups of both arms 22*b*, and do so in supine (on their back on support surface 8 shown as a table), which eliminates fall risk. Incorporating the stretching tool 1 into treatment sessions for users post hip arthroplasty, ORIF (open reduction and internal fixation) of hip fractures, and other conditions where hip motion is limited, also makes home exercises an intuitive transition. The stretching tool 1 facilitates active participation by the user 20 in their rehabilitation process helping achieve outcomes in a timely manner. FIG. 10 provides an illustration of a user 20 in a second position (B) using the stretching tool 1 to stretch their hip 21*b* with their foot 21*d* up (hidden in compartment 2*d*) and their knee 21*c* at a ninety degree bend.

Illustrative Method of Use 4: As a Leg Lifter

The stretching tool 1 may also be used to teach clients how to safely and securely assist a lower extremity 21 during transitions such as moving from sitting to supine (see arrow) and transferring into a vehicle (not shown). The design of the stretching tool 1 disclosed and claimed is an improvement over the prior art leg lifting devices. During use the user 20 engages both of their upper extremities 22 (back, hands, arms and shoulders) to compensate for the weak (recovering) lower limb. Further, the user has minimal concerns of their foot slipping out of the compartment of the bag unlike the prior art where the user is typically concerned their foot may slip off the device.

Additionally, during exercising or stretching, the stretching tool allows the user 20 to place a load on the lower extremity for contracting and stretching a hip, a knee, a hamstring or a heel cord of the lower extremity, without any limitation and restriction. To relax the hip, the knee, the hamstring or the heel cord of the lower extremity, the user 20 may release the load on the lower extremity to induce flexibility in the lower extremity, subject to the particular application of the stretching tool, without any restriction. The method of exercising, as described, further reduces the resistance and improves the flexibility of the muscles during exercising.

Illustrative Method of Use 5: Heel Cord Stretching

FIG. 12 provides an illustration of a user 20 using the stretching tool 1 with their leg elevated to stretch the heelcord of their leg. The stretching tool 1 is effective for stretching the heel cord and calf musculature of leg 21*a* without the patient 20 having to maintain their balance, decreasing their risk of falling. The stretching tool 1 is also applicable when active assistive dorsiflexion is indicated, such as prior to reintroduction of weight bearing activities after some surgeries and injuries. Dorsiflexion can be facilitated using the stretching tool 1 by applying force to the thumb side of both handles and moving the toes towards the shin (not shown as foot 21*d* is in bag compartment 2*d*). This type of stretch may be combined with the hamstring stretch shown in FIG. 8 in some circumstances.

OTHER USES AND APPLICATIONS

One of ordinary skill in the art will appreciate that the stretching tool and its method of use is not limited to users recovering from injuries or surgery and may be used by mainstream sports enthusiasm seeking assistive technology and methods for yoga, martial arts, golf, etc. Flexibility is crucial for maximum muscular function whether you are a competing athlete or staying active for the health of it. Tight hamstring musculature is a common condition for many and the stretching tool disclosed and claimed herein is an effective tool for self-stretching the hamstrings for performance enhancement and injury prevention. The stretching tool 1 disclosed and claimed herein holds at least several advantages over traditional hamstring stretching methods including allowing the user to stretch in the laying down position which stabilizes the pelvis and lumbar spine, which facilitates a more concentrated hamstring stretch while protecting low back structures. Because the stretching tool 1 disclosed and claimed herein allows the user to lay down during the stretch process, it also eliminates the need for the user to maintain their balance, further improving the stretch as standing can increase the difficulty of relaxing during the stretching process.

It should be noted that the stretching tool 1 is not limited to the specific embodiments pictured and described herein, but is intended to apply to all similar apparatuses and methods for providing the various benefits of those elements, which such benefits are explicitly and/or inherently disclosed herein. Modifications and alterations from the described embodiments will occur to those skilled in the art without departure from the spirit and scope of the stretching tool 1 and method of stretching disclosed herein. Furthermore, variations and modifications of the foregoing are within the scope of the stretching tool and method for post-surgery patient recovery. It is understood that the stretching tool and method for post-surgery patient recovery as disclosed herein extends to all alternative combinations of one or more of the individual features mentioned, evident from the text and/or drawings, and/or inherently disclosed. All of these different combinations constitute various alternative aspects of the stretching tool and method for post-surgery patient recovery. The embodiments described herein explain the best modes known for practicing the stretching tool and method for post-surgery patient recovery and will enable others skilled in the art to utilize the same. The claims are to be construed to include alternative embodiments to the extent permitted by the prior art.

What is claimed is:

1. The method of stretching a lower extremity compromising:

a) positioning a user in a supine position on a supported surface;

b) providing an exercise device wherein a foot of the user is inserted into a compartment of the exercise device, said exercise device further comprising:

i. a bag forming a compartment portion and having an open side allowing entry into the compartment portion, the compartment portion of suitable size and shape to allow insertion and enclosure of the user's foot within the compartment portion for stretching of the lower extremity in relation to the inserted foot;

ii. a strap having a first and second end, wherein the first end of the first strap is attached to the bag proximate the open side of the bag at a first position and the second end of the first strap is attached at a second position proximate the open side of the bag, the first strap generally forming a first u-shaped loop;

iii. a second strap having a first and second end, wherein the first end of the second strap is attached to the bag proximate the open side of the bag at a third position and the second end of the second strap is attached at a fourth position proximate the open side of the bag, the second strap generally forming a second u-shaped loop, wherein the first strap and the second strap are generally parallel in relation to each other; and, iv. a plurality of shorter straps positioned along the length of each of the first strap and the second strap;

v. a grip affixed to each of the shorter straps of the plurality of shorter straps;

c) engaging an upper extremity of the user with a grip of the plurality of grips of the first strap and a grip of the plurality of grips of the second strap, each grip engaged is positioned a similar distance from the bag;

d) placing a load on the lower extremity of the user by pulling said engaged grips of the first and second straps for the purpose of contracting and stretching a hip, a knee, a hamstring or a heel cord of the lower extremity stretched; and, e) releasing the load on the lower extremity of the user by relaxing the pulling of said engaged grips of the first and second straps for the purpose of the relaxing the hip, the knee, the hamstring or the heel cord of the lower extremity stretched to induce flexibility in the lower extremity stretched.

2. The method of stretching a lower extremity according to claim 1 wherein the shorter straps of the exercise apparatus are positioned substantially equidistant from each other along the length of both the first strap and the second strap.

3. The method of stretching a lower extremity according to claim 1 wherein the exercise apparatus is constructed from fabric.

4. The method of stretching a lower extremity according to claim 1 wherein the grip of the exercise apparatus is constructed from rigid plastic.

* * * * *